US008274343B2

(12) United States Patent
Cho

(10) Patent No.: US 8,274,343 B2
(45) **Date of Patent: *Sep. 25, 2012**

(54) STACKED COPLANAR WAVEGUIDES HAVING SIGNAL AND GROUND LINES EXTENDING THROUGH PLURAL LAYERS

(75) Inventor: Hsiu-Ying Cho, Hsin-Chu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/273,815

(22) Filed: Oct. 14, 2011

(65) Prior Publication Data

US 2012/0094480 A1 Apr. 19, 2012

Related U.S. Application Data

(63) Continuation of application No. 12/345,283, filed on Dec. 29, 2008, now Pat. No. 8,058,953.

(51) Int. Cl.
*H01P 3/08* (2006.01)

(52) U.S. Cl. ..... 333/238; 333/246; 257/664

(58) Field of Classification Search ..... 333/238, 333/246; 257/664, 728
See application file for complete search history.

(56) References Cited

U.S. PATENT DOCUMENTS

| | | | | |
|---|---|---|---|---|
| 4,626,889 | A | 12/1986 | Yamamoto et al. | |
| 5,408,053 | A * | 4/1995 | Young | 174/264 |
| 6,490,379 | B2 | 12/2002 | Boudreau et al. | |
| 7,081,648 | B2 | 7/2006 | Tsai | |
| 8,058,953 | B2 * | 11/2011 | Cho | 333/238 |
| 2001/0033209 | A1 | 10/2001 | Ogawa | |
| 2005/0248421 | A1 | 11/2005 | Joodaki | |
| 2007/0241844 | A1 | 10/2007 | Kim et al. | |

* cited by examiner

*Primary Examiner* — Benny Lee
(74) *Attorney, Agent, or Firm* — Slater & Matsil, L.L.P.

(57) ABSTRACT

An integrated circuit structure includes a semiconductor substrate; an interconnect structure over the semiconductor substrate; a first dielectric layer over the semiconductor substrate and in the interconnect structure; a second dielectric layer in the interconnect structure and over the first dielectric layer; and a wave-guide. The wave-guide includes a first portion in the first dielectric layer and a second portion in the second dielectric layer. The first portion adjoins the second portion.

19 Claims, 10 Drawing Sheets

STACKED COPLANAR WAVEGUIDES HAVING SIGNAL AND GROUND LINES EXTENDING THROUGH PLURAL LAYERS

This application is a continuation of U.S. patent application Ser. No. 12/345,283, filed Dec. 29, 2008, and originally entitled "Stacked Coplanar Wave-Guides," issued as U.S. Pat. No. 8,058,953 on Nov. 15, 2011, which application is incorporated herein by reference.

TECHNICAL FIELD

This invention relates generally to integrated circuits, and more particularly to stacked coplanar wave-guides.

BACKGROUND

Wave-guides are important elements in microwave circuit applications. These devices provide the interconnection between active and passive devices of microwave circuits. A wave-guide is a type of transmission line widely utilized in monolithic microwave integrated circuit (MMIC) applications.

For MMIC applications, wave-guides are often formed as coplanar wave-guides, wherein the ground lines and the signal lines of the same wave-guide are formed in a same plane, often parallel to the plane of the underlying semiconductor substrate. The manufacturing processes of the coplanar wave-guides may be compatible with the existing manufacturing process of the integrated circuits. Further, being able to be formed on the same substrate as CMOS circuits, the wave-guides are readily integrated with the CMOS circuits.

FIG. 1 illustrates a conventional coplanar wave-guide 2, which includes signal line 4, and ground lines 6 on opposite sides of signal line 4. Signal line 4 and ground lines 6 are in a same horizontal plane. Wave-guide 2 is formed over a high-k dielectric layer 10, which is further formed on passivation layer 12. Inter-metal dielectrics (IMDs) 14 underlie coplanar wave-guide 2, wherein IMDs 14 are used for forming metal lines therein. Substrate 16 underlies IMDs 14.

Being formed in the top layer, the conventional wave-guide 2 as shown in FIG. 1 is relatively far away from substrate 16, and hence the energy loss in substrate 16 is expected to be less than forming wave-guide 2 in any layer underlying high-k dielectric layers. However, the wavelength of the microwave that may be carried is typically much greater than the vertical distance between wave-guide 2 and substrate 16. For example, the electro-magnetic wavelength in $SiO_2$ dielectric material is about 3000 μm at 50 GHz. For lower frequencies, the wavelength will be even greater. The wavelength far exceeds the total thickness of layers 10, 12, 14, and the like. Therefore, the distance that can be increased by forming wave-guide 2 in the top layer is very small compared to the wavelength of the microwave signal, and hence the effect of reducing energy loss by increasing the vertical distance is limited.

The conventional wave-guide 2 as shown in FIG. 1 also suffers from other drawbacks. The thickness T of ground lines 6 is determined by the process for manufacturing the respective chip, and hence has little room for modification. This puts a limitation on the adjustment of the characteristic impedance of wave-guide 2. Accordingly, what is needed in the art is a structure and methods for forming wave-guides without incurring the above-discussed problems.

SUMMARY OF THE INVENTION

In accordance with one aspect of the present invention, an integrated circuit structure includes a semiconductor substrate; an interconnect structure over the semiconductor substrate; a first dielectric layer over the semiconductor substrate and in the interconnect structure; a second dielectric layer in the interconnect structure and over the first dielectric layer; and a wave-guide. The wave-guide includes a first portion in the first dielectric layer; and a second portion in the second dielectric layer. The first portion adjoins the second portion.

In accordance with another aspect of the present invention, an integrated circuit structure includes a semiconductor substrate; and a plurality of dielectric layers. The plurality of dielectric layers includes inter-metal dielectric (IMD) layers over the semiconductor substrate, wherein the IMD layers include a first IMD, and a second IMD over the first IMD, and a passivation layer over the IMD layers. The integrated circuit structure further includes a wave-guide including a signal line; a first ground line; and a second ground line on an opposite side of the signal line than the first ground line. At least one of the signal line, the first ground line, and the second ground line extends into a first dielectric layer and a second dielectric layer in the plurality of dielectric layers.

The advantageous features of the present invention include more flexibility in the layout of the coplanar wave-guides, improved quality of the wave-guides, and improved ability of adjusting the characteristic impedances of the wave-guides.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

A novel coplanar wave-guide is provided. Variations of the preferred embodiments are then discussed. Throughout the various views and illustrative embodiments of the present invention, like reference numbers are used to designate like elements.

Figure 1:
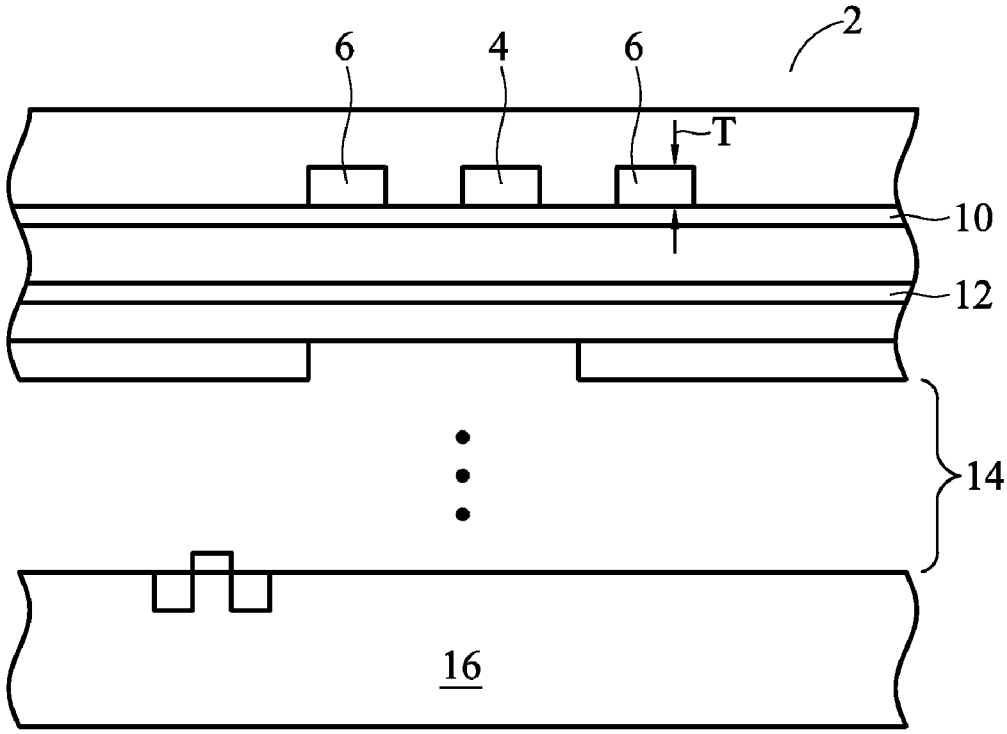
FIG. 1 (PRIOR ART)
FIG. 1 illustrates a cross-sectional view of a conventional coplanar wave-guide formed using a CMOS compatible process, wherein the wave-guide is formed in a top dielectric layer above a high-k dielectric layer.
Figure 2A:
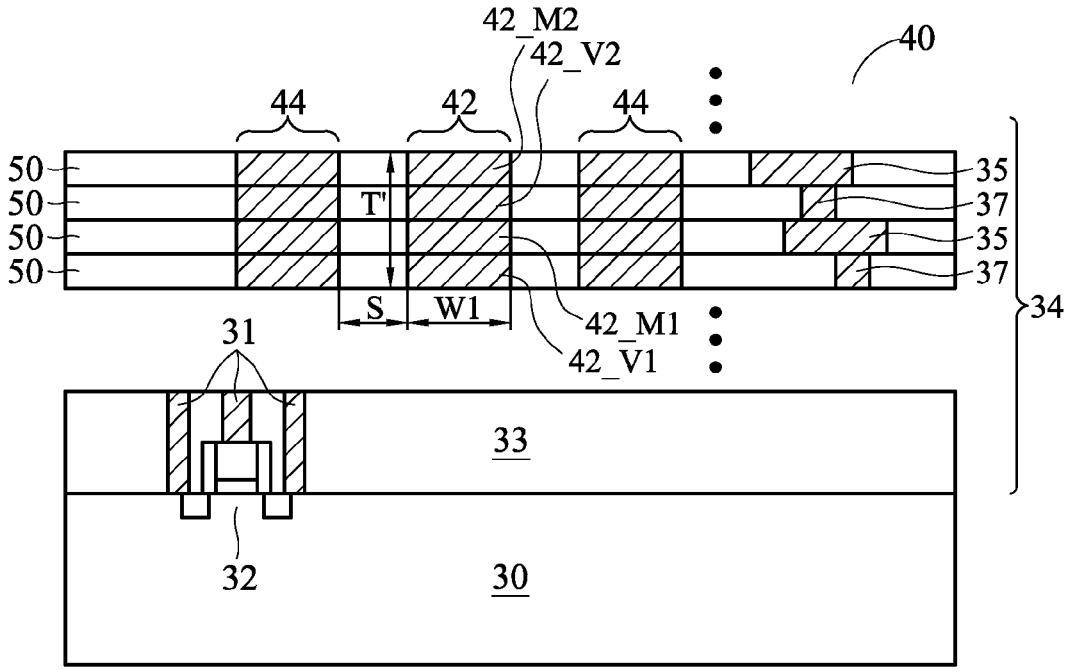
FIGS. 2A and 2B illustrate a cross-sectional view and a perspective view, respectively, of an embodiment of the present invention, wherein a wave-guide includes stacked portions in different layers.
Figure 2B:
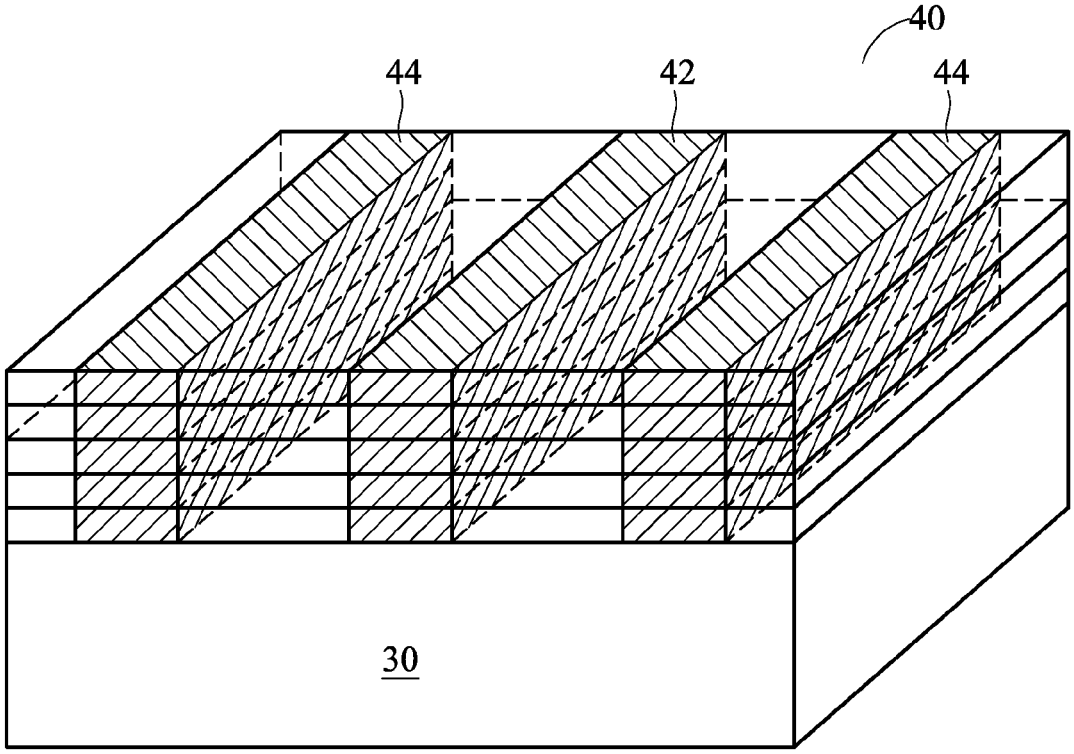

FIGS. 2A and 2B illustrate a cross-sectional view and a perspective view, respectively, of an exemplary structure including a wave-guide structure. Semiconductor substrate 30, which may be formed of a commonly used semiconductor material, such as silicon or silicon germanium, is provided. Integrated circuits 32 (FIG. 2A), which may include complementary metal-oxide-semiconductor (CMOS) devices, are symbolized using a MOS transistor. Integrated circuits 32 may be formed at the surface of semiconductor substrate 30 (as shown in FIG. 2A). Interconnect structure 34 is formed over semiconductor substrate 30 (as shown in FIG. 2A). Interconnect structure 34 includes metal lines 35 and vias 37 (as shown in FIG. 2A), which are used to interconnect integrated circuit 32, and to connect integrated circuit 32 to the bond pads (not shown) formed on the top surface of the respective semiconductor chip.

Coplanar wave-guide 40 is formed in interconnect structure 34. Coplanar wave-guide 40 includes signal line 42 and ground lines 44, which are on opposite sides of signal line 42. At least one of the signal line 42 and ground lines 44 includes more than one layer, each in one dielectric layer, stacked together. The dielectric layers in which coplanar wave-guide 40 are formed are denoted as dielectric layers 50. In an embodiment, dielectric layers 50 include inter-metal dielectrics (IMDs), which may be formed of low-k dielectric materials having k values less than, for example, about 3.5, and may even be less than about 2.5 (and hence are referred to as extreme low-k dielectric layers). In other embodiments, dielectric layers 50 include one or more un-doped silicate glass (USG) layer(s), which are formed over low-k dielectric layers. The USG layer(s) may also underlie a passivation layer. In yet other embodiments, dielectric layers 50 include a passivation layer formed over the USG layer(s), wherein the passivation layer preferably has a k value equal to or greater than about 3.9.

Coplanar wave-guide 40, depending on the positions of the residing dielectric layers 50, may include different materials formed using different methods. For example, when formed in IMDs and USGs, coplanar wave-guide 40 may include a portion (either a portion of signal line 42 or ground lines 44) formed of copper using the commonly known single damascene or dual damascene processes. As is known in the art, the damascene processes include forming openings in dielectric layer(s), filling the openings with a metallic material, and performing a chemical mechanical polish to remove portions of the metallic material outside the opening.

Figure 3:
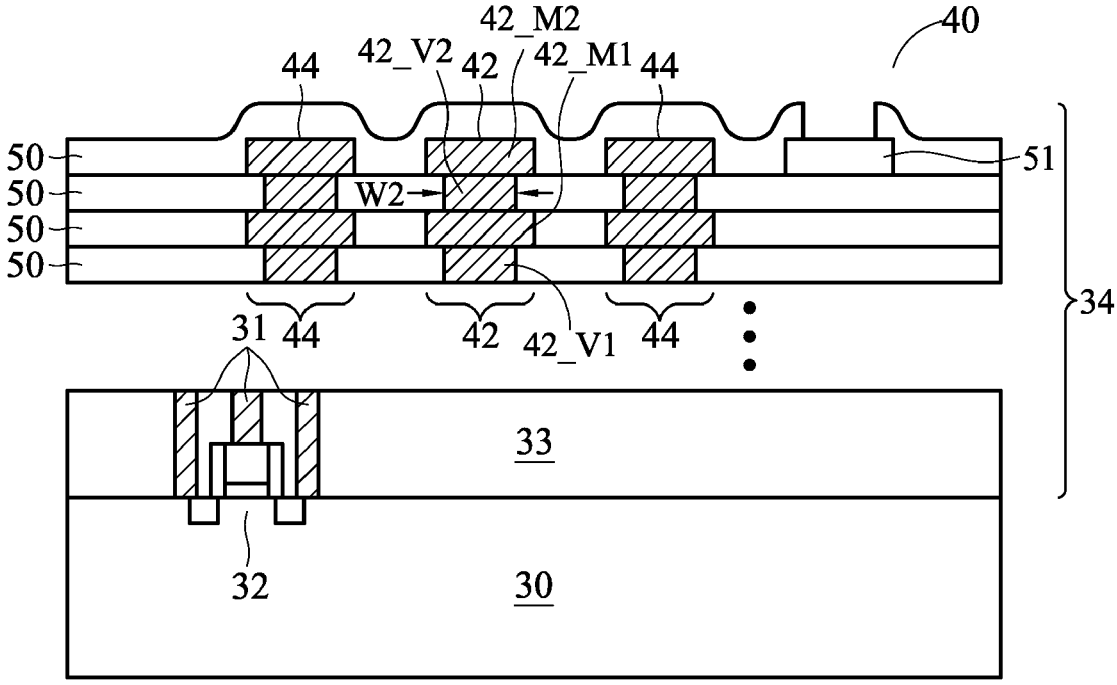
FIG. 3 illustrates a cross-sectional view of an alternative embodiment, wherein metal line portions and via portions of a wave-guide have different widths.

On the other hand, the portion of coplanar wave-guide 40 formed in the passivation layer may include aluminum, tungsten, silver, and the like, and may be formed by depositing a metallic layer, and then etching the metallic layer to form a desirable pattern. For example, FIG. 3 illustrates that coplanar wave-guide 40 includes a top layer formed in passivation layer 50, wherein the top layer of wave-guide 40 is in a same layer as, and formed simultaneously with, bond pad 51.

Wave-guide 40 may include two or more layers stacked together, wherein the layers of wave-guide 40 may be in any level of interconnect structure 34 including, but not limited to, the bond pad layer in which bond pads are formed, inter-layer dielectric (ILD) 33 in which contact plugs 31 are formed (as shown in FIG. 2A), and/or any dielectric layers between the bond pad layer and ILD 33. In FIGS. 2A and 3, an upper layer and a lower layer are illustrated, although wave-guide 40 may include more layers. Each of the layers of wave-guide 40 may include metal line portions and the underlying via portions, wherein the metal line portions of signal line 42 include 42_M2 and 42_M1, while the via portions of signal line 42 include 42_V2 and 42_V1. In an embodiment, metal lines portions 42_M2 and 42_M1 and via portions 42_V2 and 42_V1 have a same width W1 (FIG. 2A), and hence signal line 42 is an integrated line having a rectangular cross-sectional view. In alternative embodiments, as shown in FIG. 3, signal portions 42_M2, 42_M1, 42_V2, and 42_V1 have different widths W1 and W2. Similarly, ground lines 44 may also span several metal layers, and different portions of ground lines 44 may have a same width or different widths.

Figure 4:
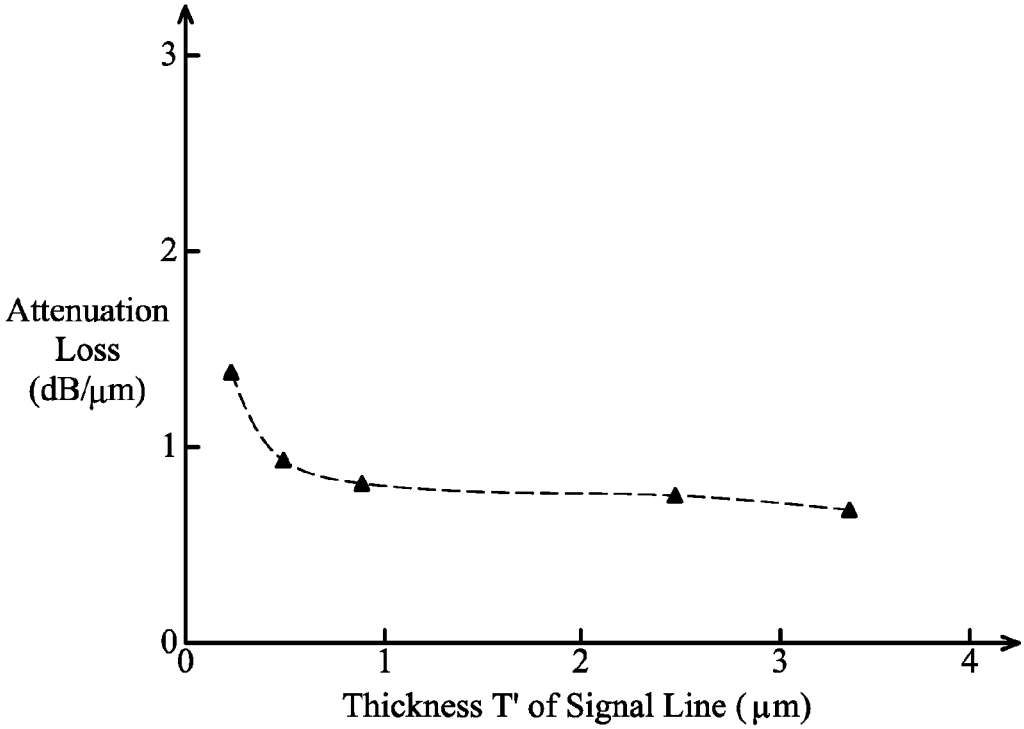
FIG. 4 shows simulation results, wherein the attenuation losses of wave-guides are illustrated as a function of the thicknesses of signal lines.
Figure 5:
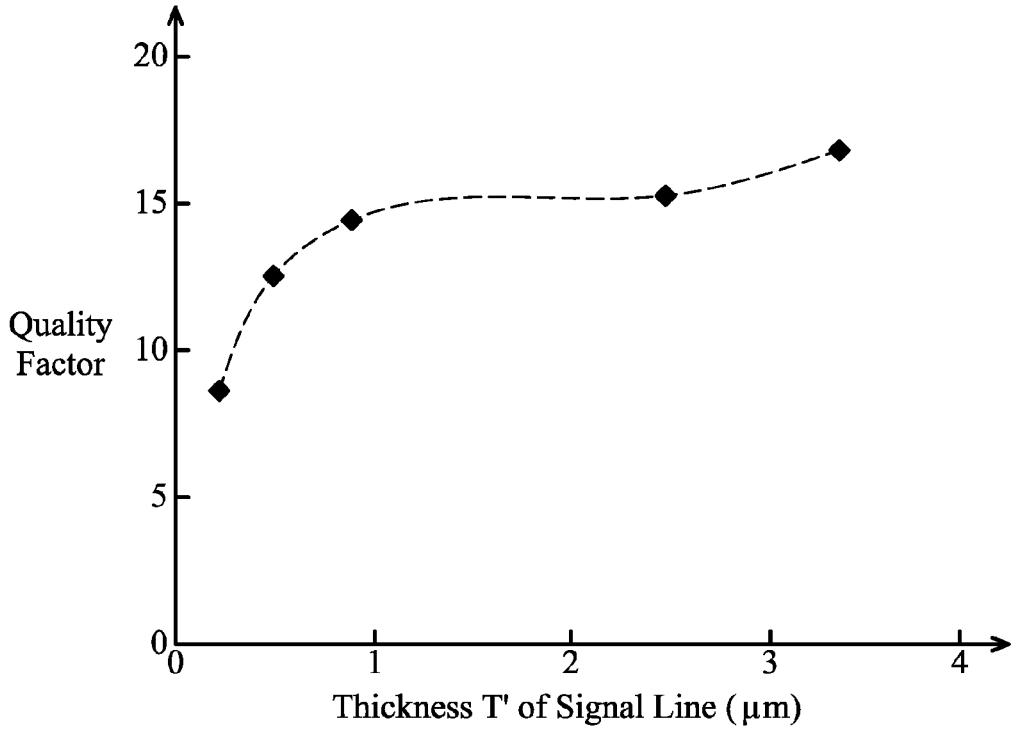
FIG. 5 shows simulation results, wherein the quality factors of wave-guides are illustrated as a function of the thicknesses of signal lines.

It is found that with the signal line 42 and ground lines 44 spanning more than one layer, the thicknesses of signal line 42 and ground lines 44 are increased, and hence better wave-guides can be formed. FIG. 4 illustrates a simulation result showing the attenuation losses in wave-guides as a function of thicknesses T' of signal lines 42 (refer to FIG. 2A, wherein thickness T' is measured all the way from the top to the bottom of signal line 42). FIG. 4 reveals that with the increase of thickness T', the attenuation loss decreases. FIG. 5, on the other hand, shows simulation results indicating that with the increase of thickness T', the quality factor of the wave-guides is improved.

Figure 6:
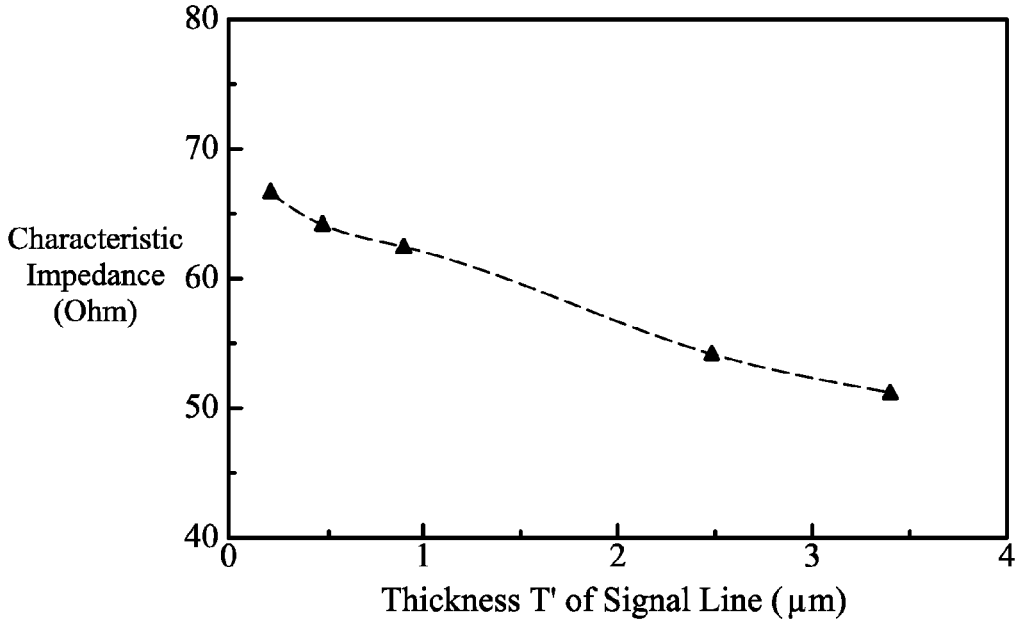
FIG. 6 shows simulation results, wherein the characteristic impedances of wave-guides are illustrated as a function of the thicknesses of signal lines.
Figure 7:
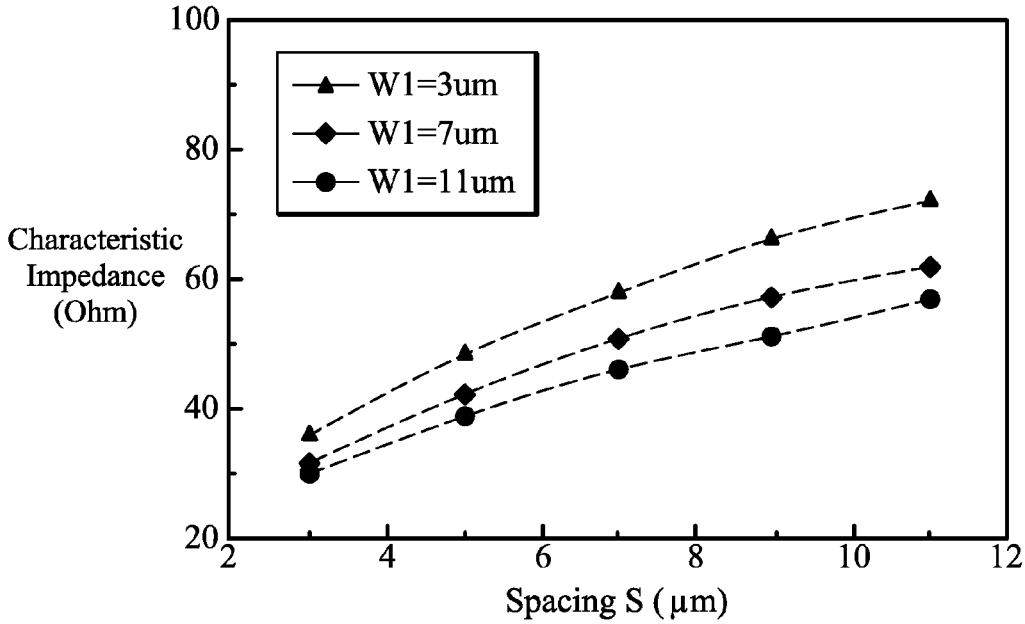
FIG. 7 shows simulation results, wherein the characteristic impedances of wave-guides are illustrated as a function of the spaces between a signal line and ground lines.

It is also found that by adjusting the thickness of signal line 42 and/or ground lines 44, the characteristic impedance of the resulting wave-guide 40 can be adjusted. For example, as shown in FIG. 6, with the increase in thickness T' of signal line 42, the characteristic impedance of wave-guide 40 decreases. In embodiments, the adjustment of thickness T' may be combined with the adjustment of other dimensions, such as width W1 of signal line 42 and spacing S between signal line 42 and ground lines 44 (FIG. 2A), so that the characteristic impedances of the wave-guides may be adjusted in a greater range. For example, FIG. 7 illustrates that when width W1 of signal line 42 increases, (for example, from 3 μm to 7 μm, to 11 μm, as shown in the legend of FIG. 7), the characteristic impedance of wave-guide 40 is reduced, and when spacing S between signal line 42 and ground lines 44 increases, the characteristic impedance also increases.

Figure 8:
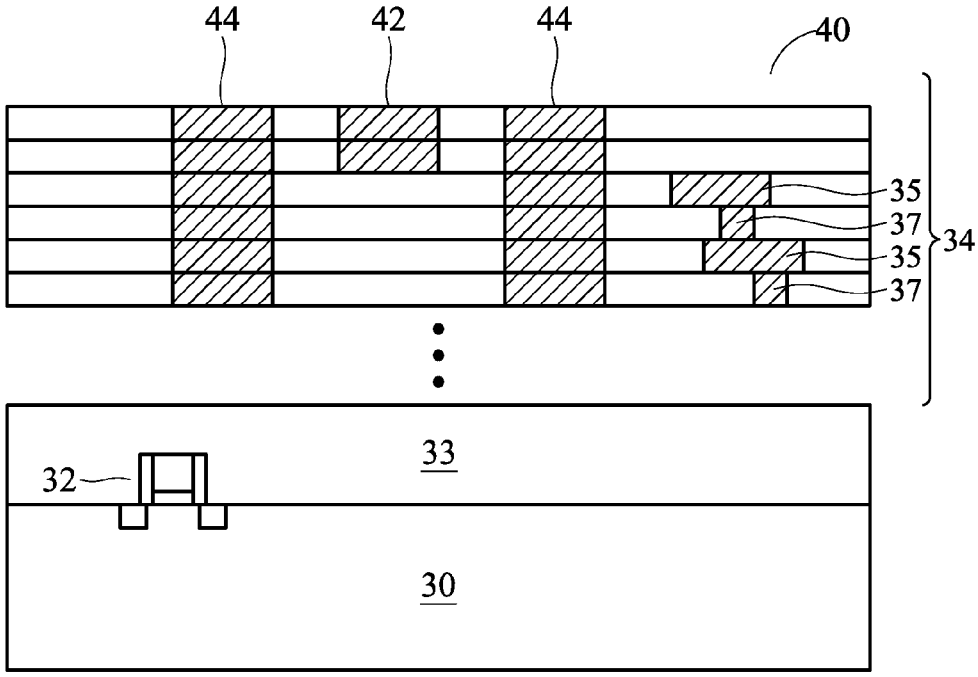
FIGS. 8 through 13 illustrate wave-guides whose signal lines have different thicknesses than ground lines.
Figure 9:
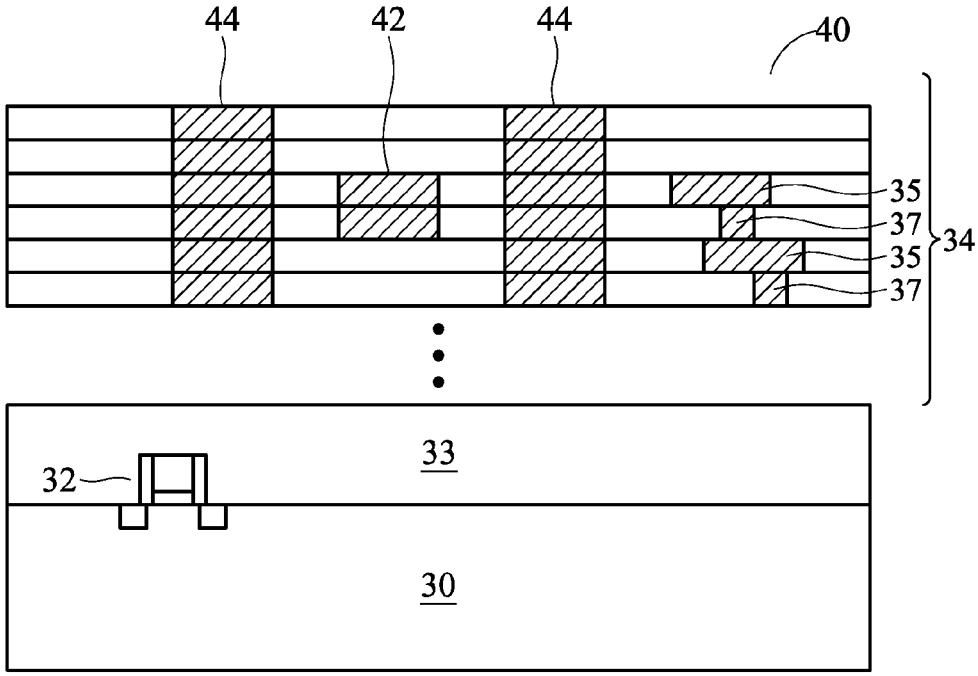
Figure 10:
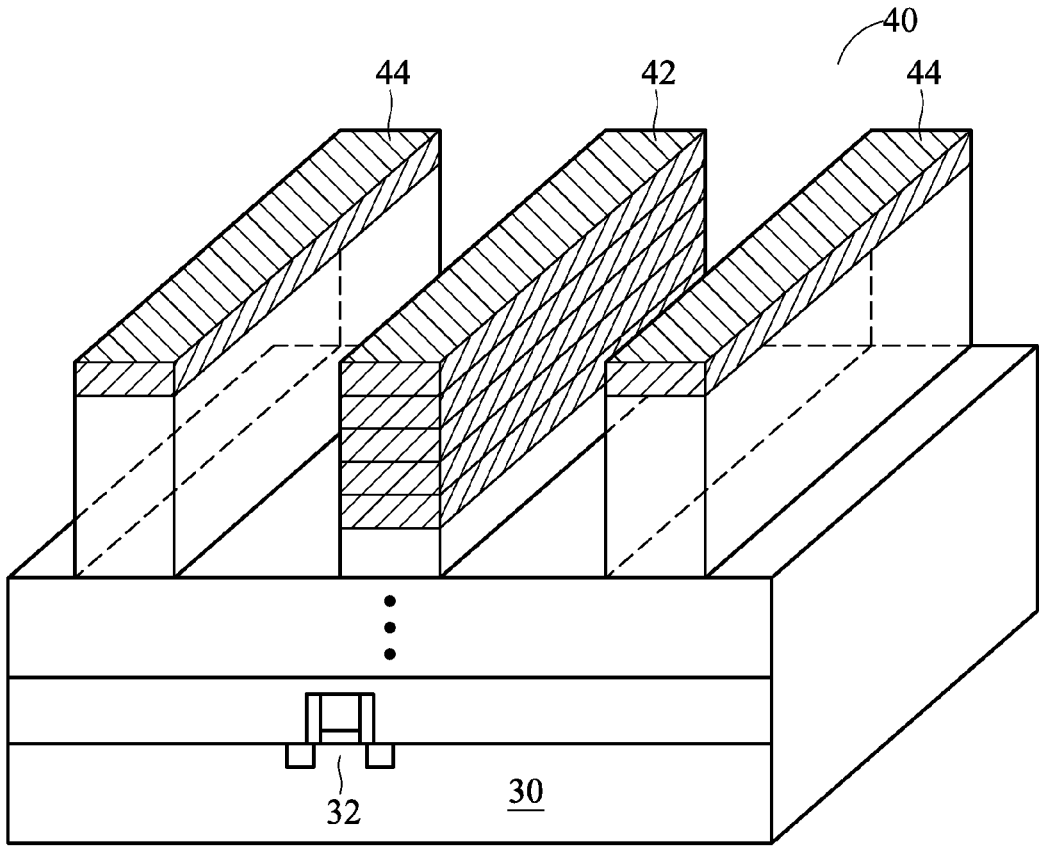
Figure 11:
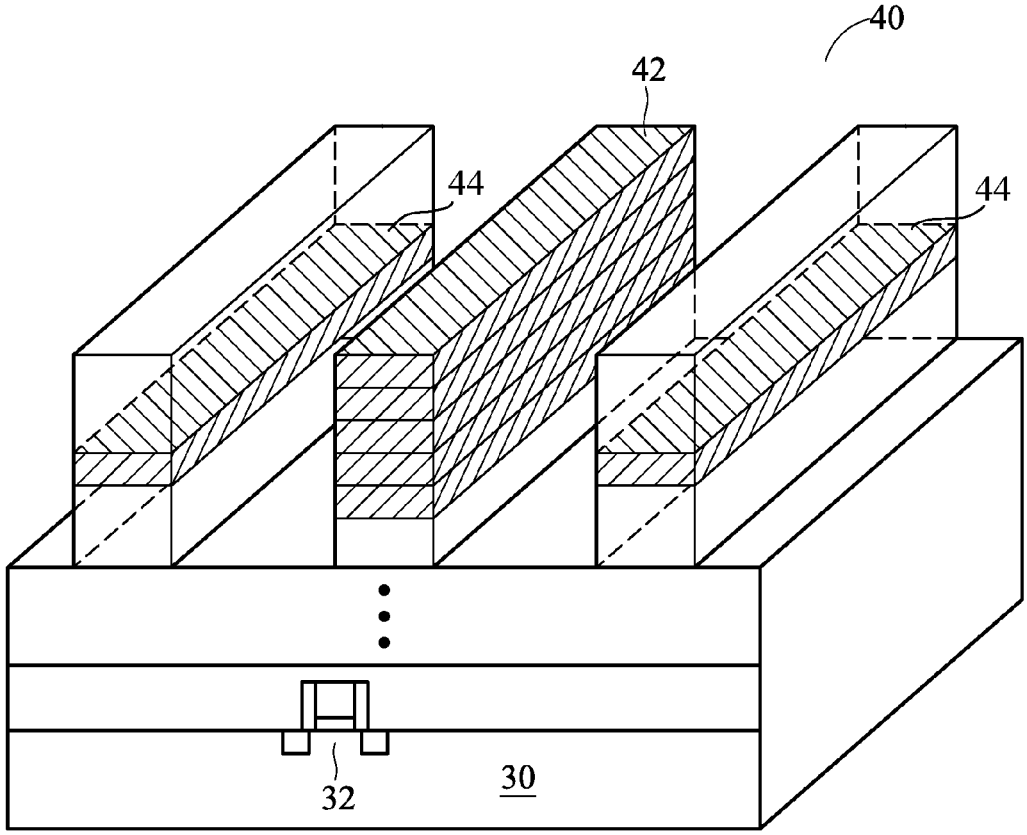
Figure 12:
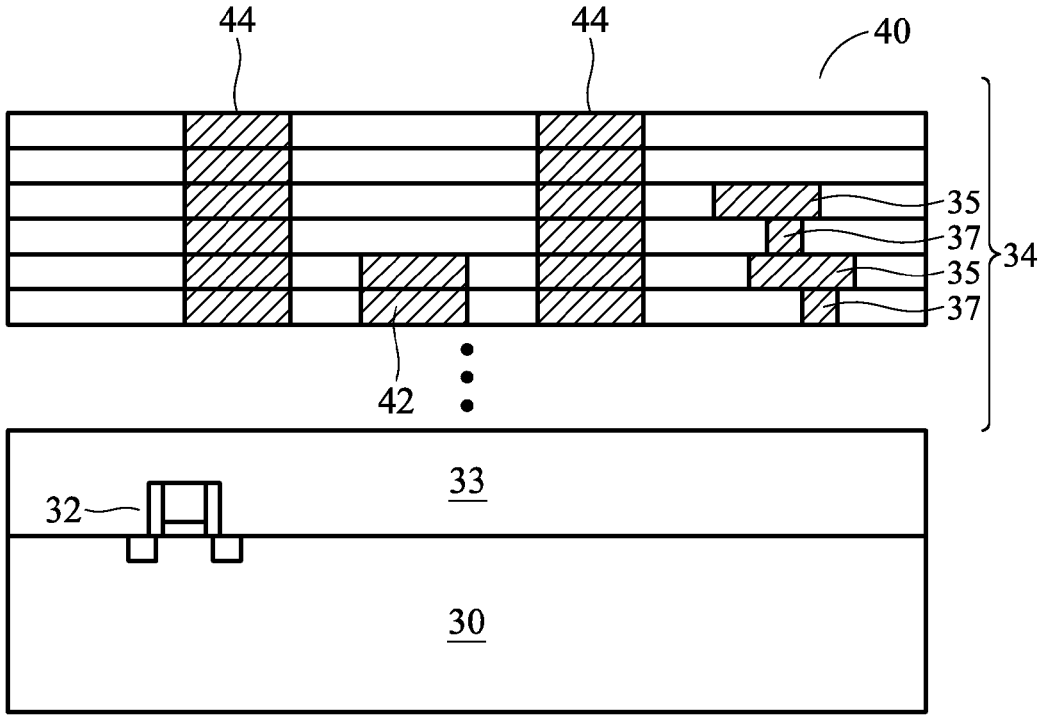
Figure 13:
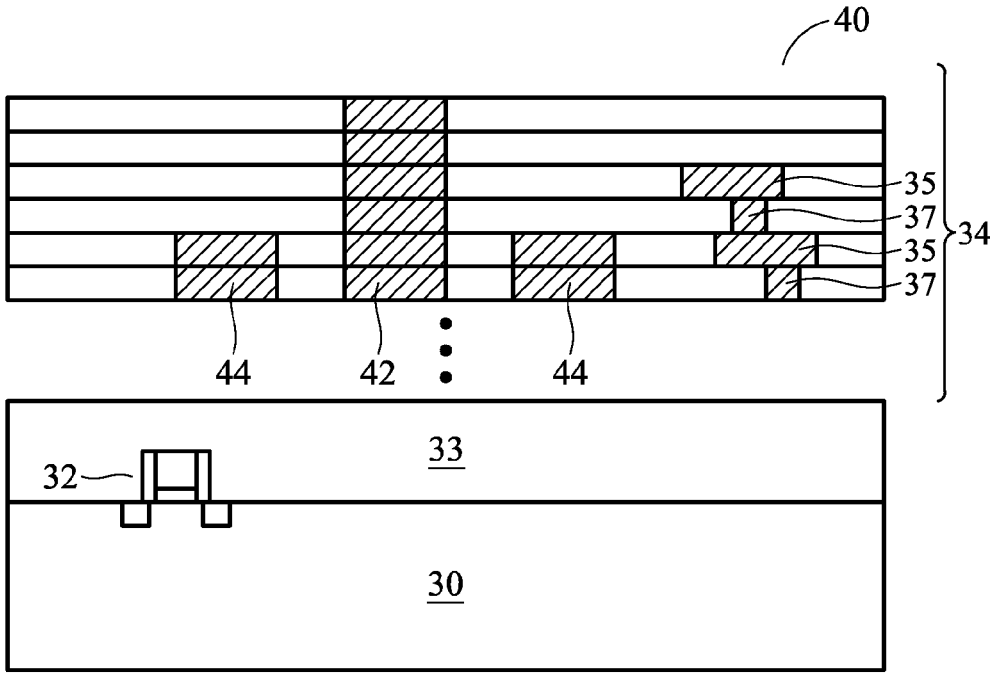

FIGS. 8 and 9 illustrate alternative structures including exemplary wave-guides, wherein signal line 42 and ground lines 44 extend into different numbers of metal layers. In FIG. 8, ground lines 44 extend into multiple metal layers, and signal line 42 is formed only in top one(s) of the multiple metal layers. Alternatively, FIG. 12 illustrates an alternative embodiment in which signal line 42 is formed only in bottom one(s) of the multiple metal layers. In FIG. 9, ground lines 44 extend into multiple metal layers, and signal line 42 is formed only in intermediate one(s) of the multiple metal/dielectric layers. Signal line 42 may also be formed only in bottom one(s) of the multiple metal layers in which ground lines 44 are formed. In alternative embodiments, signal line 42 may extend into more metal layers than ground lines 44, with ground lines 44 being formed only in top one(s), intermediate one(s), or bottom one(s) of the multiple metal/dielectric layers in which signal line 42 is formed. The respective exemplary embodiments are shown in FIGS. 10, 11 and 13. In FIG. 10, ground lines 44 extend into fewer metal layers than signal line 42, and may be in the top metal layer(s) in which signal line 42 is located. Alternatively, as shown in FIG. 11, ground lines 44 are formed only in intermediate one(s) of the multiple metal/dielectric layers in which signal line 42 is located. In yet other embodiments, as shown in FIG. 13, ground lines 44 may be formed only in bottom one(s) of the multiple metal/dielectric layers in which signal line 42 is located.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method comprising:

forming a first dielectric layer over a semiconductor substrate;

forming a second dielectric layer over the first dielectric layer; and forming a wave-guide comprising:

forming a signal line comprising a first portion in the first dielectric layer and a second portion in the second dielectric layer, wherein the second portion contacts the first portion, and wherein edges of the first portion are vertically aligned to corresponding edges of the second portion; and forming a first ground line and a second ground line on opposite sides of the signal line and in the first and the second dielectric layers, wherein at least one of the signal line, the first ground line, and the second ground line comprises a metal line portion and a via portion under the metal line portion, wherein the steps of forming the signal line and the first and the second ground lines comprise damascene processes.

2. The method of claim 1, wherein the signal line has a thickness different from a thickness of the first ground line and the second ground line.

3. The method of claim 2 further comprising:

forming a third dielectric layer over the second dielectric layer; and forming a portion of the signal line in the third dielectric layer, wherein the first ground line and the second ground do not extend into the third dielectric layer.

4. The method of claim 2 further comprising:

forming a third dielectric layer under the first dielectric layer and over the substrate; and forming a portion of the first ground line and a portion of the second ground line in the third dielectric layer, wherein the signal line does not extend into the third dielectric layer.

5. The method of claim 4 further comprising:

forming a fourth dielectric layer over the second dielectric layer; and forming a portion of the first ground line and a portion of the second ground line in the fourth dielectric layer, wherein the signal line does not extend into the fourth dielectric layer.

6. The method of claim 2 further comprising:

forming a third dielectric layer over the second dielectric layer; and forming a portion of the first ground line and a portion of the second ground line in the third dielectric layer, wherein the signal line does not extend into the third dielectric layer.

7. The method of claim 2 further comprising:

forming a third dielectric layer under the first dielectric layer; and forming a portion of the signal line in the third dielectric layer, wherein the first ground line and the second ground line do not extend into the third dielectric layer.

8. A method comprising:

forming a dielectric layer over a semiconductor substrate;

forming a passivation layer over the dielectric layer; and forming a wave-guide comprising:

forming a first portion in the dielectric layer; and forming a second portion in the passivation layer, wherein the first portion adjoins the second portion.

9. The method of claim 8, wherein the wave-guide comprises a signal line and a ground line, and wherein both the signal line and the ground line extends into the passivation layer.

10. The method of claim 8 further comprising forming a bond pad in the passivation layer.

11. The method of claim 10, wherein the step of forming the second portion of the wave-guide and the step of forming the bond pad comprise:

depositing a metallic layer; and etching the metallic layer to form the second portion of the wave-guide and the bond pad.

12. The method of claim 8, wherein the first portion of the wave-guide comprises a via portion and a metal line portion, and wherein respective edges of the metal line portion and the corresponding via portion are vertically aligned.

13. The method of claim 8, wherein the step of forming the first portion of the wave-guide comprises damascene processes.

14. A method comprising:

forming a plurality of dielectric layers comprising:

forming inter-metal dielectric (IMD) layers over a semiconductor substrate; and forming a passivation layer over the IMD layers; and forming a wave-guide comprising:

forming a signal line; and forming a first ground line and a second ground line on opposite sides of the signal line, wherein the signal line has a same thickness as the first ground line and the second ground line, and wherein the signal line and the first and the second ground lines extend into at least two layers in the IMD layers and the passivation layer.

15. The method of claim 14, wherein the steps of forming the signal line, the first ground line, and the second ground line comprise damascene processes.

16. The method of claim 14, wherein each of the signal line and the first and the second ground lines extends into the passivation layer and one of the IMD layers.

17. The method of claim 16 further comprises forming a un-doped silicate glass layer under the passivation layer and over the IMD layers, wherein each of the signal line and the first and the second ground lines extends into the un-doped silicate glass layer.

18. The method of claim 16 further comprising forming a bond pad in the passivation layer.

19. The method of claim 14, wherein each of the signal line, the first ground line, and the second ground line comprises a respective metal line portion and a via portion underlying the corresponding metal line portion.

* * * * *